US011469020B2

(12) United States Patent
Otsubo et al.

(10) Patent No.: US 11,469,020 B2
(45) Date of Patent: Oct. 11, 2022

(54) COIL COMPONENT

(71) Applicant: Murata Manufacturing Co., Ltd., Kyoto (JP)

(72) Inventors: Yoshihito Otsubo, Kyoto (JP); Shinichiro Banba, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 1307 days.

(21) Appl. No.: 15/653,917

(22) Filed: Jul. 19, 2017

(65) Prior Publication Data

US 2017/0316858 A1 Nov. 2, 2017

Related U.S. Application Data

(63) Continuation of application No. PCT/JP2016/050458, filed on Jan. 8, 2016.

(30) Foreign Application Priority Data

Jan. 20, 2015 (JP) ..... JP2015-008917

(51) Int. Cl.
*H01F 5/04* (2006.01)
*H01F 17/00* (2006.01)
(Continued)

(52) U.S. Cl.
CPC ..... *H01F 5/04* (2013.01); *H01F 5/06* (2013.01); *H01F 17/0013* (2013.01);
(Continued)

(58) Field of Classification Search
CPC .. H01F 17/06; H01F 17/062; H01F 2017/065; H01F 30/16; H01F 2038/305;
(Continued)

(56) References Cited

U.S. PATENT DOCUMENTS 5,781,091 A * 7/1998 Krone ..... H01F 41/041 336/200
2007/0090916 A1* 4/2007 Rao ..... H01F 17/062 336/229

(Continued)

FOREIGN PATENT DOCUMENTS

JP 60241210 A * 11/1985 ..... H01F 17/062
JP 2000277336 A 10/2000

(Continued)

OTHER PUBLICATIONS

International Search report for PCT/JP2016/050458 dated Mar. 1, 2016.
Written Opinion report for PCT/JP2016/050458 dated Mar. 1, 2016.

*Primary Examiner* — Tszfung J Chan
(74) *Attorney, Agent, or Firm* — Pearne & Gordon LLP

(57) ABSTRACT

A coil component includes an insulating layer; an annular ring-shaped coil core embedded in the insulating layer; a coil electrode wound around the coil core; an input electrode designed for external connection, disposed on a lower surface of the insulating layer, and connected to a first end of the coil electrode; and an output electrode designed for external connection, disposed on the lower surface of the insulating layer, and connected to a second end of the coil electrode. One of the input electrode and the output electrode is disposed inside the coil core in a plan view. With this configuration, unlike a conventional coil component in which both input and output electrodes are disposed outside a coil core, it is possible not only to easily reduce the area of the coil component in a plan view, but also to improve heat dissipation characteristics of the coil component.

11 Claims, 11 Drawing Sheets

(51) Int. Cl.

| | |
|---|---|
| ***H01F 27/29*** | (2006.01) |
| ***H01F 27/28*** | (2006.01) |
| ***H01F 27/22*** | (2006.01) |
| ***H01F 17/06*** | (2006.01) |
| ***H01F 5/06*** | (2006.01) |

(52) U.S. Cl.
CPC ..... *H01F 17/0033* (2013.01); *H01F 17/06* (2013.01); *H01F 17/062* (2013.01); *H01F 27/22* (2013.01); *H01F 27/2876* (2013.01); *H01F 27/292* (2013.01); *H01F 2005/043* (2013.01)

(58) Field of Classification Search
CPC ..... H01F 27/2895; H01F 5/04; H01F 5/06; H01F 2005/043; H01F 17/0013; H01F 17/0033; H01F 2027/2809; H01F 17/0006; H01F 27/2804; H01F 5/003; H01F 27/292; H01F 27/24; H01F 27/255; H01F 27/327; H01F 17/04
USPC ..... 336/192, 200, 229, 232
See application file for complete search history.

(56) References Cited

U.S. PATENT DOCUMENTS

| | | | | |
|---|---|---|---|---|
| 2009/0002111 | A1* | 1/2009 | Harrison | H01F 41/046 336/96 |
| 2015/0061817 | A1* | 3/2015 | Lee | H01F 17/062 336/221 |

FOREIGN PATENT DOCUMENTS

| | | | | |
|---|---|---|---|---|
| JP | 2001006940 | A | 1/2001 | |
| JP | 2010516056 | A | 5/2010 | |
| JP | 2014038884 | A | 2/2014 | |
| JP | 2014127512 | A * | 7/2014 | |
| WO | WO-02080203 | A1 * | 10/2002 | H01F 17/0033 |

* cited by examiner

COIL COMPONENT

This is a continuation of International Application No. PCT/JP2016/050458 filed on Jan. 8, 2016 which claims priority from Japanese Patent Application No. 2015-008917 filed on Jan. 20, 2015. The contents of these applications are incorporated herein by reference in their entireties.

BACKGROUND OF THE DISCLOSURE

Field of the Disclosure

The present disclosure relates to a coil component that includes an insulating layer having a coil core embedded therein and a coil electrode wound around the coil core.

Description of the Related Art

Electronic devices using high-frequency signals sometimes include, for example, a toroidal coil as a component for noise suppression. The toroidal coil, which is larger in size than other electronic components mounted on a wiring board, occupies a large mounting area on the wiring board. Additionally, mounting the toroidal coil of large size on the wiring board makes it difficult to reduce the profile of the entire coil component.

Accordingly, a technique has been proposed, in which a toroidal coil is embedded in a wiring board to reduce the size of a coil component. For example, a coil component 100 illustrated in FIG. 14 and described in Patent Document 1 includes an insulating layer 101 having an annular ring-shaped coil core 102 embedded therein, and two coil electrodes 103 and 104 wound around the coil core 102. The coil electrodes 103 and 104 each include a plurality of upper wiring traces 105*a* arranged on the upper surface of the insulating layer 101, a plurality of lower wiring traces 105*b* arranged on the lower surface of the insulating layer 101, a plurality of inner columnar conductors 106*a* arranged inside the coil core 102 and each configured to connect a first end of a predetermined one of the upper wiring traces 105*a* to a first end of a predetermined one of the lower wiring traces 105*b*, and a plurality of outer columnar conductors 106*b* arranged outside the coil core 102 and each configured to connect a second end of a predetermined one of the upper wiring traces 105*a* to a second end of a predetermined one of the lower wiring traces 105*b*.

The coil electrodes 103 and 104 are each connected at both ends thereof to input and output electrodes 107*a* and 107*b*, which allow connection to an external unit. By embedding the coil core 102 in the insulating layer 101, the size and profile of the coil component 100 can be reduced.

Patent Document 1: Japanese Unexamined Patent Application Publication No. 2014-38884 (see, e.g., paragraphs 0031 to 0039, FIG. 1)

BRIEF SUMMARY OF THE DISCLOSURE

With recent reduction in the size of electronic devices, there has been a demand for further reduction in the size of coil components mounted on the electronic devices. However, in the conventional coil component 100 described above, both the input and output electrodes 107*a* and 107*b* are disposed outside the coil core 102. This makes it difficult to reduce the area of the coil component 100 in a plan view. In particular, since the input and output electrodes 107*a* and 107*b* are electrodes connected to an external unit, a predetermined area needs to be secured to ensure mountability. From this perspective too, it is difficult to reduce the size of the coil component 100.

The present disclosure has been made in view of the problems described above. An object of the present disclosure is to reduce the size of a coil component obtained by embedding a coil core in an insulating layer.

To achieve the object described above, a coil component according to the present disclosure includes an insulating layer; a coil core embedded in the insulating layer so as to surround a predetermined region; a coil electrode wound around the coil core; an input electrode designed for external connection, disposed on one of a first principal surface and a second principal surface of the insulating layer, and connected to a first end of the coil electrode; and an output electrode designed for external connection, disposed on one of the first principal surface and the second principal surface of the insulating layer, and connected to a second end of the coil electrode. One of the input electrode and the output electrode is disposed inside the coil core, or in the predetermined region, in a plan view.

In this configuration, one of the input electrode and the output electrode, which are designed for external connection, is disposed inside the coil core in a plan view. Therefore, as compared to the conventional coil component in which both the input and output electrodes are disposed outside the coil core, the area of the coil component in a plan view can be more easily reduced. In the region inside the coil core (i.e., predetermined region), where the density of conductors forming the coil electrode is high, heat generated when the coil electrode is energized tends to accumulate. When one of the input electrode and the output electrode is disposed inside the coil core, heat accumulating inside the coil core can be dissipated through the input or output electrode disposed inside the coil core. It is thus possible to improve the heat dissipation characteristics of the coil component.

The other of the input electrode and the output electrode may be disposed outside the coil core in a plan view, and both the input electrode and the output electrode may be disposed on one of the first principal surface and the second principal surface of the insulating layer. With this configuration, where both the input electrode and the output electrode are disposed on the same principal surface of the insulating layer, the mountability of the coil component to an external unit can be improved.

The other of the input electrode and the output electrode may also be disposed inside the coil core in a plan view. In this case, since both the input electrode and the output electrode are disposed inside the coil core in a plan view, it is possible to further reduce the size of the coil component.

At least one of the input electrode and the output electrode may be connected to a dummy conductor designed for heat dissipation and disposed internally in the insulating layer. With this configuration, which includes the dummy conductor, it is possible to further improve the heat dissipation characteristics of the coil component.

The coil electrode may include a plurality of first wiring traces each having a first end disposed inside the coil core and a second end disposed outside the coil core, the plurality of first wiring traces being arranged on the first principal surface of the insulating layer in a winding axis direction of the coil electrode; a plurality of second wiring traces each having a first end disposed inside the coil core and a second end disposed outside the coil core, the plurality of second wiring traces being arranged on the second principal surface of the insulating layer in the winding axis direction of the coil electrode so as to form a plurality of pairs with the respective first wiring traces; a plurality of inner conductors disposed inside the coil core, the plurality of inner conductors each being configured to connect the first end of one of the first wiring traces to the first end of the second wiring trace forming a pair with the one of the first wiring traces; and a plurality of outer conductors disposed outside the coil core, the plurality of outer conductors each being configured to connect the second end of one of the first wiring traces to the second end of a second wiring trace adjacent to the second wiring trace forming a pair with the one of the first wiring traces. The inner conductors and the outer conductors may each be formed by a metal pin.

If the inner and outer conductors are formed by via conductors or through-hole conductors which require forming through-holes, adjacent conductors need to be spaced at predetermined intervals to form independent through-holes. This means that it is not easy to narrow the gaps between adjacent conductors to increase the number of coil turns. In the case of the metal pins which do not require forming through-holes, the gaps between adjacent metal pins can be easily narrowed. Therefore, when both the inner and outer conductors are formed by metal pins, it is possible to increase the number of turns of the coil electrode and improve the coil characteristics (i.e., achieve high inductance).

Since the metal pins are lower in resistivity than through-hole conductors and via conductors formed by filling via-holes with a conductive paste, the resistance value of the entire coil electrode can be reduced. The coil component having excellent coil characteristics, such as a high quality factor, can thus be provided.

The coil electrode may include a plurality of first wiring traces each having a first end disposed inside the coil core and a second end disposed outside the coil core, the plurality of first wiring traces being arranged on the first principal surface of the insulating layer in a winding axis direction of the coil electrode; a plurality of second wiring traces each having a first end disposed inside the coil core and a second end disposed outside the coil core, the plurality of second wiring traces being arranged on the second principal surface of the insulating layer in the winding axis direction of the coil electrode so as to form a plurality of pairs with the respective first wiring traces; a plurality of inner conductors disposed inside the coil core, the plurality of inner conductors each being configured to connect the first end of one of the first wiring traces to the first end of the second wiring trace forming a pair with the one of the first wiring traces; and a plurality of outer conductors disposed outside the coil core, the plurality of outer conductors each being configured to connect the second end of one of the first wiring traces to the second end of a second wiring trace adjacent to the second wiring trace forming a pair with the one of the first wiring traces. The dummy conductor, the inner conductors, and the outer conductors may each be formed by a metal pin. The dummy conductor may be larger in diameter than the inner conductors and the outer conductors.

In this configuration, small-diameter metal pins are used as the inner conductors and the outer conductors to increase the number of turns of the coil electrode, whereas a large-diameter metal pin is used as the dummy metal pin to improve the heat dissipation characteristics of the coil component.

The coil core may be formed in the shape of a ring. In this case, it is possible to reduce the size and improve the heat dissipation characteristics of the coil component that includes the coil core formed in the shape of a ring.

The coil core may be formed in the shape of a ring having a gap. In this case, it is possible to reduce the size and improve the heat dissipation characteristics of the coil component that includes the coil core formed in the shape of a ring having a gap.

In the present disclosure, one of the input electrode and the output electrode, which are designed for external connection, is disposed inside the coil core in a plan view. Therefore, as compared to the conventional coil component in which both the input and output electrodes are disposed outside the coil core, the area of the coil component in a plan view can be more easily reduced. In the region inside the coil core (i.e., the predetermined region), where the density of conductors forming the coil electrode is high, heat generated when the coil electrode is energized tends to accumulate. When one of the input electrode and the output electrode is disposed inside the coil core, heat accumulating inside the coil core can be dissipated through the input or output electrode disposed inside the coil core. It is thus possible to improve the heat dissipation characteristics of the coil component.

DETAILED DESCRIPTION OF THE DISCLOSURE

First Embodiment

Figure 1:
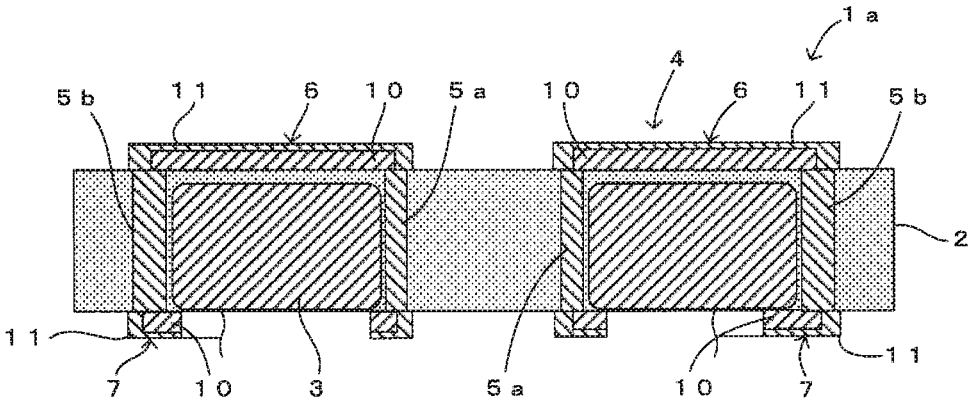
FIG. 1 is a cross-sectional view of a coil component according to a first embodiment of the present disclosure.
Figure 2:
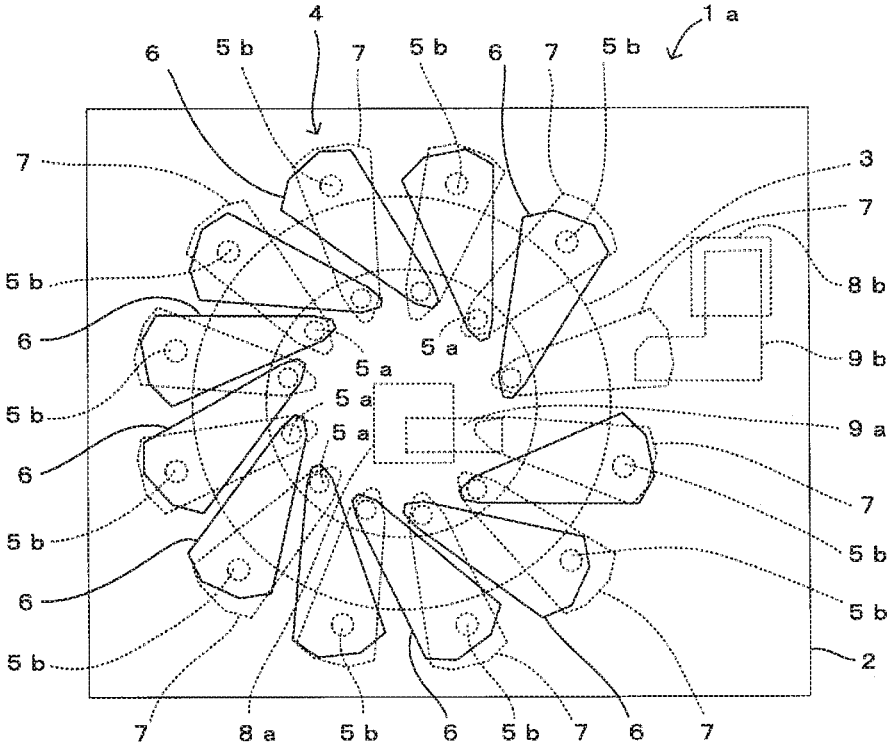
FIG. 2 is a plan view of the coil component illustrated in FIG. 1.
Figure 3A:
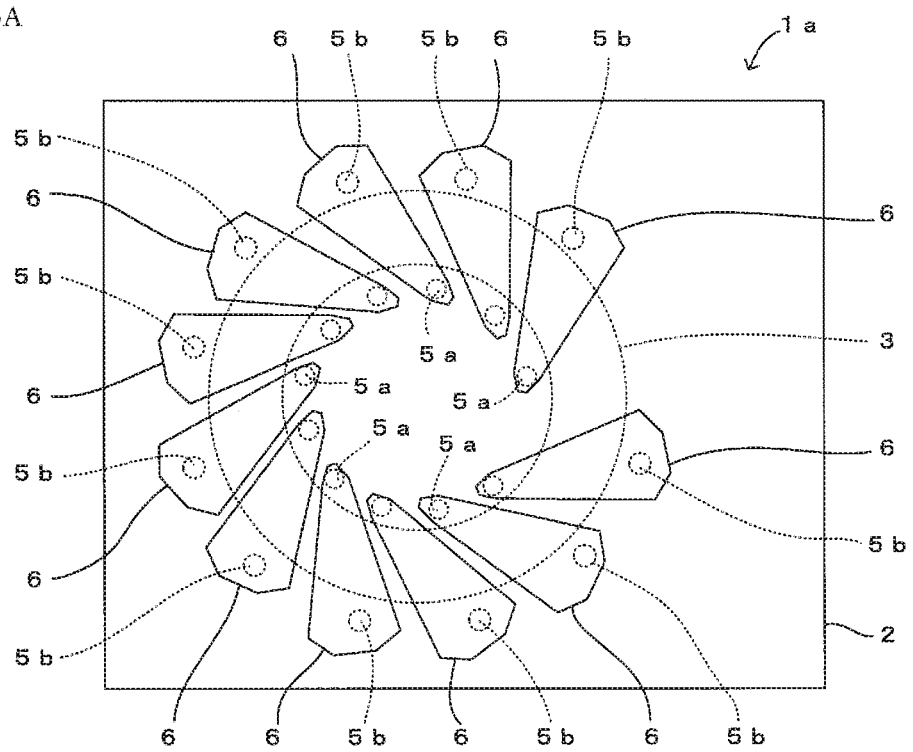
FIGS. 3A and 3B illustrate wiring traces illustrated in FIG. 1.
Figure 3B:
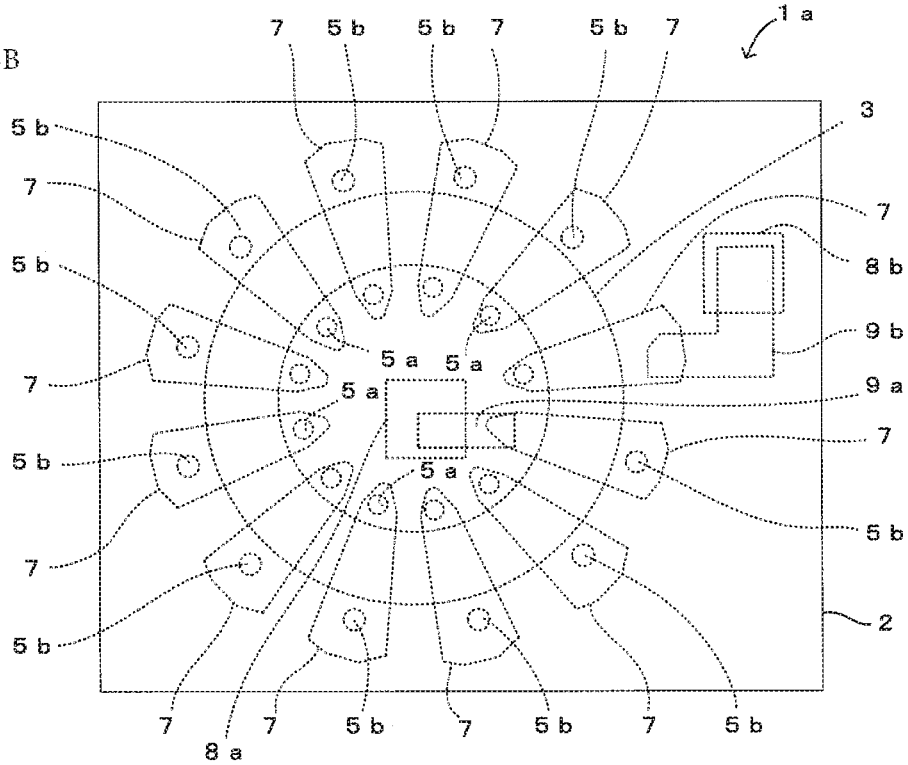

A coil component 1*a* according to a first embodiment of the present disclosure will be described with reference to FIGS. 1 to 3A and 3B. FIG. 1 is a cross-sectional view of the coil component 1*a*, FIG. 2 is a plan view of the coil component 1*a*, and FIGS. 3A and 3B illustrate wiring traces 6 and 7. FIG. 3A is a plan view of the coil component 1*a* without the lower wiring traces 7, extended wires 9*a* and 9*b*, and input and output electrodes 8*a* and 8*b*. FIG. 3B is a plan view of the coil component 1*a* without the upper wiring traces 6.

As illustrated in FIGS. 1 to 3A and 3B, the coil component 1*a* according to the present embodiment includes an insulating layer 2 having a coil core 3 embedded therein, a coil electrode 4 wound around the coil core 3, the input electrode 8*a* designed for external connection and connected to a first end of the coil electrode 4, and the output electrode 8*b* designed for external connection and connected to a second end of the coil electrode 4. The coil component 1*a* is mounted on an electronic device, such as a cellular phone, using high-frequency signals.

The insulating layer 2 is made of resin, such as epoxy resin, and is formed to a predetermined thickness to cover the coil core 3 and a plurality of metal pins 5*a* and 5*b* (described below). In the present embodiment, the principal surfaces (upper and lower surfaces) of the insulating layer 2 are formed to be rectangular.

The coil core 3 is made of a magnetic material, such as Mn—Zn ferrite, used to form typical coil cores. As illustrated in FIG. 2, the coil core 3 is shaped to surround a predetermined region of the insulating layer 2 in a plan view. Specifically, the coil core 3 of the present embodiment is formed in the shape of an annular ring, and a region inside the annular ring corresponds to the predetermined region. The coil core 3 does not necessarily need to be in the shape of an annular ring, and may be formed, for example, in the shape of a polygonal or oval loop.

The input electrode 8*a* and the output electrode 8*b*, which are used as electrodes for external connection, each have a relatively large area to ensure mountability to an external unit and connection strength. This means that if both the input electrode 8*a* and the output electrode 8*b* are disposed outside the coil core 3 in a plan view, it is difficult to reduce the size of the coil component 1*a*. Additionally, when the coil core 3 has an annular shape, heat generated when the coil electrode 4 is energized tends to accumulate on the inner periphery side of the coil core 3 due to high electrode density of the coil electrode 4. Accordingly, in the present embodiment, the input electrode 8*a* is disposed in the region inside the coil core 3 (i.e., within the predetermined region) in a plan view, so as to reduce the size and improve the heat dissipation characteristics of the coil component 1*a*.

The input electrode 8*a* and the output electrode 8*b* will now be specifically described, together with the coil electrode 4. The coil electrode 4 is helically wound around the coil core 3. The coil electrode 4 includes the plurality of upper wiring traces 6 arranged on the upper surface (corresponding to "first principal surface" of the present disclosure) of the insulating layer 2, the plurality of lower wiring traces 7 arranged on the lower surface (corresponding to "second principal surface" of the present disclosure) of the insulating layer 2 so as to form a plurality of pairs with the respective upper wiring traces 6, and the plurality of inner metal pins 5*a* and outer metal pins 5*b* each configured to connect a predetermined one of the upper wiring traces 6 to a predetermined one of the lower wiring traces 7.

The upper wiring traces 6 are arranged in the winding axis direction of the coil electrode 4 (i.e., in the circumferential direction of the coil core 3 or the direction of magnetic flux lines generated when the coil electrode 4 is energized), with first ends thereof disposed inside (i.e., on the inner periphery side of) the coil core 3, and second ends thereof disposed outside (i.e., on the outer periphery side of) the coil core 3. Like the upper wiring traces 6, the lower wiring traces 7 are arranged in the winding axis direction of the coil electrode 4, with first ends thereof disposed inside the coil core 3, and second ends thereof disposed outside the coil core 3. In the present embodiment, the upper and lower wiring traces 6 and 7 are formed to taper in the direction from the outer periphery side toward the inner periphery side.

In the present embodiment, as illustrated in FIG. 3B, the first and second ends of the coil electrode 4 are each formed by one lower wiring trace 7. The lower wiring trace 7 forming the first end of the coil electrode 4 is connected to the input electrode 8*a*, with the extended wire 9*a* on the inner periphery side of the coil core 3 interposed therebetween. On the other hand, the lower wiring trace 7 forming the second end of the coil electrode 4 is connected to the output electrode 8*b*, with the extended wire 9*b* on the outer periphery side of the coil core 3 interposed therebetween. That is, the input electrode 8*a* and the output electrode 8*b* disposed on the inner periphery side and the outer periphery side, respectively, of the coil core 3 in a plan view are both on the lower surface of the insulating layer 2. With this configuration of the coil electrode 4, when one of the input electrode 8*a* and the output electrode 8*b* is disposed on the inner periphery side of the coil core 3 and the other is disposed on the outer periphery side of the coil core 3, it is possible to easily arrange the input electrode 8*a* and the output electrode 8*b* on the same surface (the upper or lower surface) of the insulating layer 2 without reducing the number of turns of the coil electrode 4.

In the present embodiment, the upper and lower wiring traces 6 and 7, the input and output electrodes 8*a* and 8*b*, and the extended wires 9*a* and 9*b* each have a two-layer structure composed of a base electrode 10 formed by screen printing using a conductive paste containing a metal, such as Cu or Ag, and a surface electrode 11 formed, for example, by applying a Cu coating onto the base electrode 10. Alternatively, the upper and lower wiring traces 6 and 7, the input and output electrodes 8*a* and 8*b*, and the extended wires 9*a* and 9*b* may each have a single-layer structure, which can be formed by screen printing using a conductive paste containing a metal, such as Cu or Ag, as in the case of the base electrode 10. Note that the upper wiring traces 6 correspond to "first wiring traces" of the present disclosure, and the lower wiring traces 7 correspond to "second wiring traces" of the present disclosure.

The inner metal pins 5*a* are each configured to connect the first end of one of the upper wiring traces 6 to the first end of the lower wiring trace 7 forming a pair with the one of the upper wiring traces 6, and are arranged along the inner periphery of the coil core 3 and stand upright in the thickness direction of the insulating layer 2.

The outer metal pins 5*b* are each configured to connect the second end of one of the upper wiring traces 6 to the second end of the lower wiring trace 7 adjacent on a predetermined side (i.e., in the counterclockwise direction in the present embodiment) to the lower wiring trace 7 forming a pair with the one of the upper wiring traces 6. The outer metal pins 5*b* are arranged along the outer periphery of the coil core 3 and stand upright in the thickness direction of the insulating layer 2. The inner metal pins 5*a* correspond to "inner conductors" of the present disclosure, and the outer metal pins 5*b* correspond to "outer conductors" of the present disclosure.

The upper end face of each of the inner and outer metal pins 5*a* and 5*b* is exposed from the upper surface of the insulating layer 2, and the lower end face of each of the inner and outer metal pins 5*a* and 5*b* is exposed from the lower surface of the insulating layer 2. The metal pins 5*a* and 5*b* are made of a metal material, such as Cu, Au, Ag, Al, or Cu alloy, typically used to form wiring electrodes. In the present embodiment, the metal pins 5*a* and 5*b* are cylindrical members of substantially the same diameter and length. Although the inner and outer metal pins 5*a* and 5*b* are cylindrical in shape in the present embodiment, they may be, for example, prismatic in shape. Equivalents of the inner and outer metal pins 5*a* and 5*b* may be formed by columnar conductors, such as via conductors.

Figure 4:
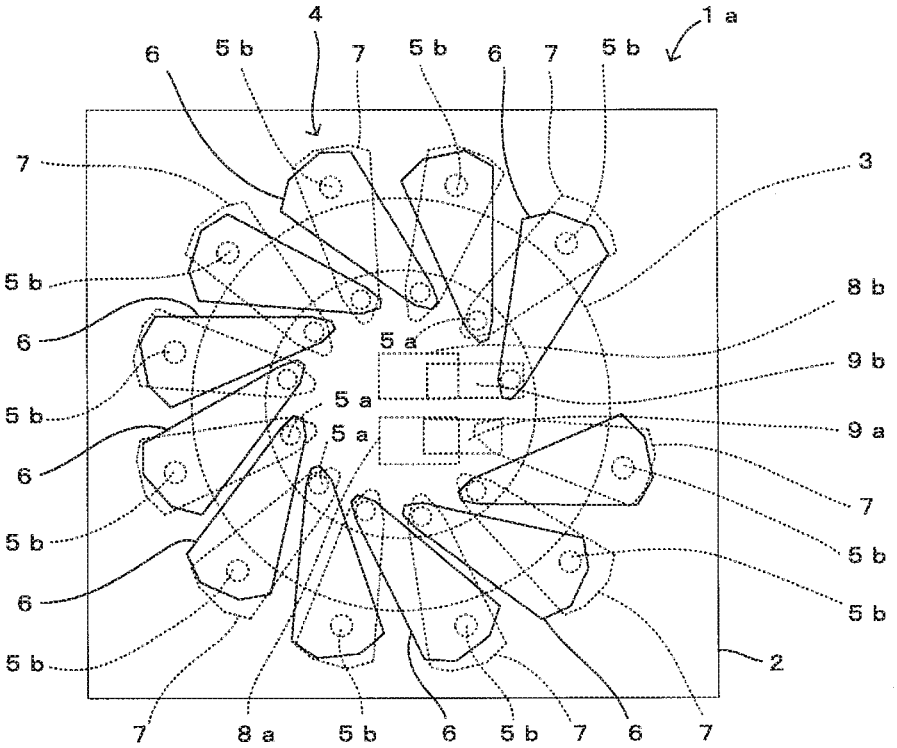
FIG. 4 illustrates a modified arrangement of the input and output electrodes illustrated in FIG. 1.

In the present embodiment, as illustrated in FIG. 4, both the input electrode 8*a* and the output electrode 8*b* may be disposed on the inner periphery side of the coil core 3 in a plan view. In this case, it is possible to further reduce the area of the coil component 1*a* in a plan view, and thus to further reduce the size of the coil component 1*a*. Although the input electrode 8*a* and the output electrode 8*b* are both disposed on the lower surface of the insulating layer 2 in the present embodiment, the electrodes 8*a* and 8*b* may both be disposed on the upper surface of the insulating layer 2, or may be separately disposed on the upper and lower surfaces of the insulating layer 2. Note that FIG. 4 is a plan view of the coil component 1*a* and illustrates a modified arrangement of the input and output electrodes 8*a* and 8*b*.

The upper and lower surfaces of the insulating layer 2 may be provided with respective insulation coatings for protecting the wiring traces 6 and 7 and the extended wires 9*a* and 9*b*. In this case, the insulation coating for protecting the lower surface of the insulating layer 2 may have openings at portions corresponding to the respective electrodes 8*a* and 8*b* to expose the electrodes 8*a* and 8*b*. The insulation coatings may be made of, for example, polyimide or epoxy resin.

(Method for Manufacturing Coil Component)

A method for manufacturing the coil component 1*a* will now be briefly described.

First, the metal pins 5*a* and 5*b* are arranged on a first principal surface of a flat transfer plate. In this case, the upper end faces of the metal pins 5*a* and 5*b* are secured to the first principal surface of the transfer plate such that the metal pins 5*a* and 5*b* are secured in an upright position. The metal pins 5*a* and 5*b* can be formed, for example, by shearing metal wires (e.g., Cu, Au, Ag, Al, or Cu alloy wires) which are circular in cross-section.

Next, a resin layer is formed on a first principal surface of a flat plate-like resin sheet having a release layer thereon. In this case, the resin sheet, the release layer, and the resin layer are placed in this order. The resin layer is formed in an uncured state.

Next, the transfer plate is placed upside-down over the resin sheet such that the lower end faces of the metal pins 5*a* and 5*b* are in contact with the resin layer. Then, the resin of the resin layer is cured.

After the transfer plate is peeled off, the coil core 3 is placed at a predetermined position on the resin sheet. The metal pins 5*a* and 5*b* and the coil core 3 are molded, for example, of epoxy resin to form the insulating layer 2 on the resin sheet.

Next, the resin sheet having the release layer thereon is peeled off, and the front and back surfaces of the insulating layer 2 are polished or ground. This exposes the upper end faces of the metal pins 5*a* and 5*b* from the upper surface of the insulating layer 2, and exposes the lower end faces of the metal pins 5*a* and 5*b* from the lower surface of the insulating layer 2.

Last, the upper wiring traces 6 are formed on the upper surface of the insulating layer 2, whereas the lower wiring traces 7, the input and output electrodes 8*a* and 8*b*, and the extended wires 9*a* and 9*b* are formed on the lower surface of the insulating layer 2, and thus the manufacture of the coil component 1*a* is completed. The upper and lower wiring traces 6 and 7, the input and output electrodes 8*a* and 8*b*, and the extended wires 9*a* and 9*b* can be formed, for example, by screen printing using a conductive paste containing a metal, such as Cu. A Cu coating may be applied onto the wiring traces, which are formed using the conductive paste, to form a two-layer structure. Other exemplary methods for forming the upper and lower wiring traces 6 and 7, the input and output electrodes 8*a* and 8*b*, and the extended wires 9*a* and 9*b* include etching a plate-like member coated with Cu foil on a first principal surface thereof into a predetermined pattern shape (i.e., the shape of the upper wiring traces 6 or lower wiring traces 7). Such plate-like members are prepared individually for both the traces to be formed on the upper surface of the insulating layer 2 and the traces to be formed on the lower surface of the insulating layer 2. In this case, the upper and lower wiring traces 6 and 7 can be bonded to the upper and lower end faces of the metal pins 5*a* and 5*b* by ultrasonic bonding using the plate-like members.

In the embodiment described above, one of the input electrode 8*a* and the output electrode 8*b*, which are designed for external connection, is disposed inside the coil core 3 in a plan view. Therefore, as compared to the conventional coil component in which both the input and output electrodes are disposed outside the coil core, the area of the coil component 1*a* in a plan view can be reduced. In the region inside the coil core 3 (i.e., predetermined region), where the density of conductors (e.g., inner metal pins 5*a*) forming the coil electrode 4 is high, heat generated when the coil electrode 4 is energized tends to accumulate. When one of the input electrode 8*a* and the output electrode 8*b* is disposed inside the coil core 3, heat accumulating inside the coil core 3 can be dissipated through the one of the input and output electrodes 8*a* and 8*b* disposed inside the coil core 3. It is thus possible to improve the heat dissipation characteristics of the coil component 1*a*.

Additionally, since both the input electrode 8*a* and the output electrode 8*b* are disposed on the lower surface of the insulating layer 2, the mountability of the coil component 1*a* to an external unit can be improved.

If the metal pins 5*a* and 5*b* are replaced by via conductors or through-hole conductors, which require forming through-holes, adjacent conductors need to be spaced at predetermined intervals to form independent through-holes. This means that it is not easy to narrow the gaps between adjacent conductors to increase the number of turns of the coil electrode. In the case of the metal pins 5*a* and 5*b*, which do not require forming through-holes as in the present embodiment, the gaps between adjacent metal pins 5*a* and 5*b* can be easily narrowed. It is thus possible to increase the number of turns of the coil electrode 4 and improve the coil characteristics (i.e., achieve high inductance).

Since the metal pins 5*a* and 5*b* are lower in resistivity than through-hole conductors and via conductors formed by filling via-holes with a conductive paste, the resistance value of the entire coil electrode 4 can be reduced. The coil component 1*a* having excellent coil characteristics, such as a high quality factor, can thus be provided.

(Modification of Coil Core)

Figure 5:
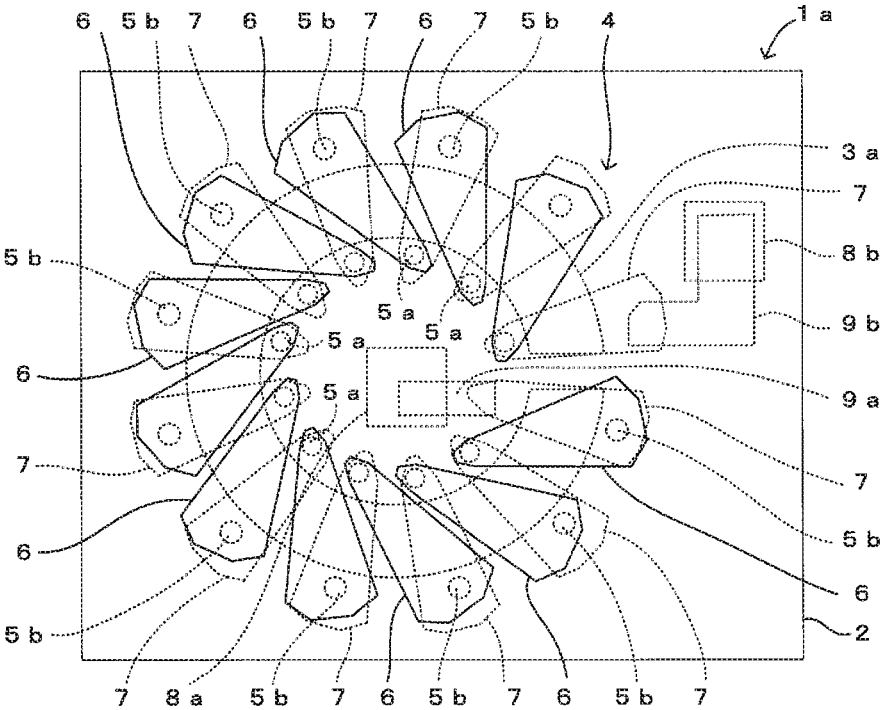
FIG. 5 illustrates a modification of the coil core illustrated in FIG. 1.

A modification of the coil core 3 of the present embodiment will now be described with reference to FIG. 5. FIG. 5 is a plan view of the coil component 1*a* and illustrates a modification of the coil core 3.

Although the coil core 3 is formed in the shape of an annular ring in the embodiment described above, the shape of the coil core 3 may be appropriately changed as long as it surrounds the predetermined region. For example, as illustrated in FIG. 5, a coil core 3*a* in the shape of an annular ring having a gap may be used. With this configuration, it is still possible to reduce the size and improve the heat dissipation characteristics of the coil component 1*a*.

Second Embodiment

Figure 6:
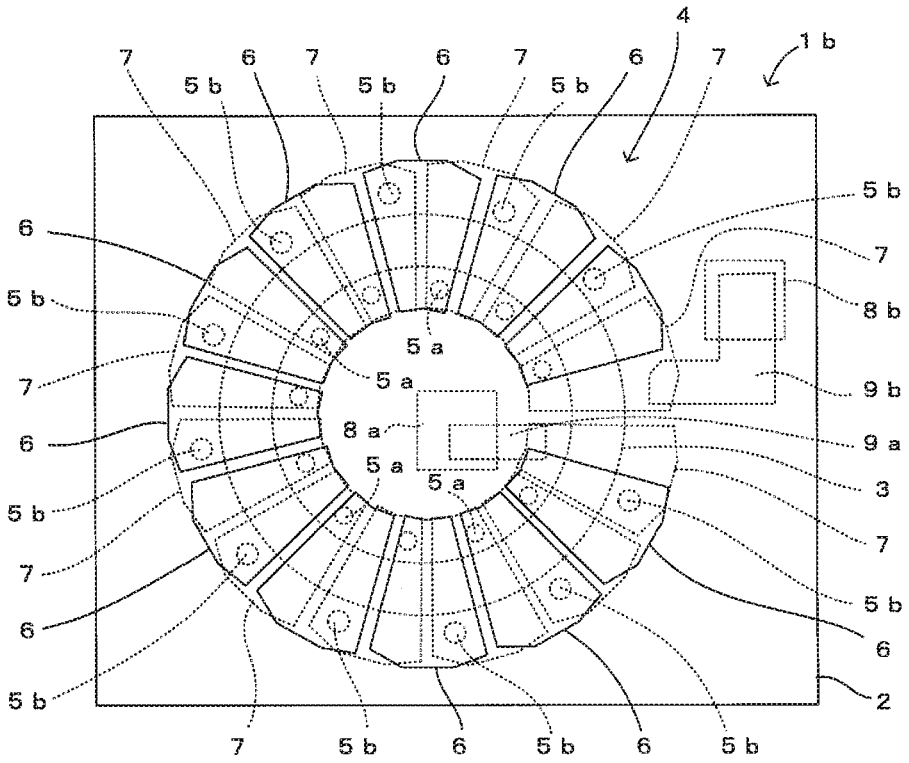
FIG. 6 is a plan view of a coil component according to a second embodiment of the present disclosure.
Figure 7A:
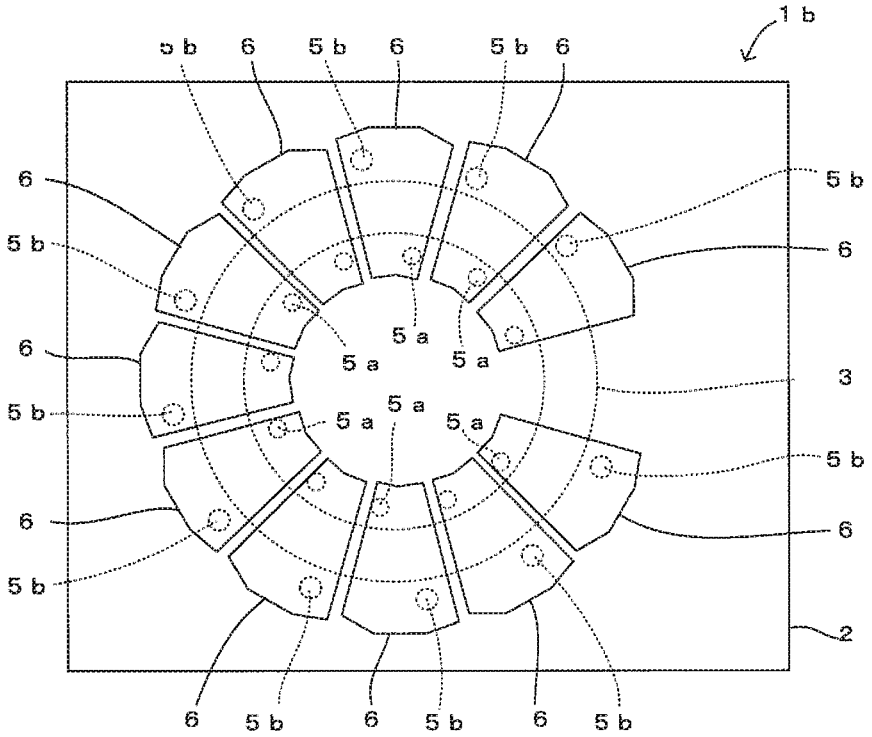
FIGS. 7A and 7B illustrate wiring traces illustrated in FIG. 6.
Figure 7B:
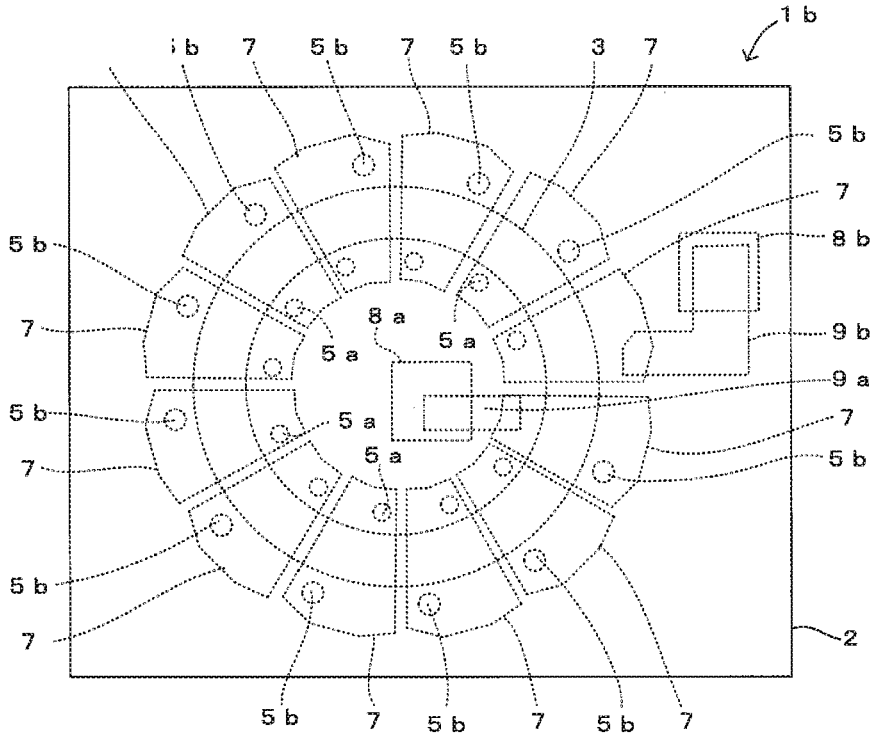

A coil component 1*b* according to a second embodiment of the present disclosure will be described with reference to FIGS. 6, 7A and 7B. FIG. 6 is a plan view of the coil component 1*b*, and FIGS. 7A and 7B illustrate the wiring traces 6 and 7. FIG. 7A is a plan view of the coil component 1*b* without the lower wiring traces 7, the extended wires 9*a* and 9*b*, and the input and output electrodes 8*a* and 8*b*. FIG. 7B is a plan view of the coil component 1*b* without the upper wiring traces 6.

The coil component 1*b* according to the present embodiment differs from the coil component 1*a* of the first embodiment described with reference to FIGS. 1 to 3A and 3B in the shape of the upper and lower wiring traces 6 and 7, as illustrated in FIGS. 6, 7A and 7B. The other elements are the same as those of the coil component 1*a* of the first embodiment, and their description will be omitted by giving them the same reference numerals as those in the first embodiment.

In this case, the upper and lower wiring traces 6 and 7 are of substantially the same shape. The upper wiring traces 6 are arranged at regular intervals, and the lower wiring traces 7 are also arranged at regular intervals (regular pitches).

Additionally, in the present embodiment, the intervals between adjacent upper wiring traces 6 are designed to be substantially the same in size as the intervals between adjacent lower wiring traces 7. Note that the phrase "the upper and lower wiring traces 6 and 7 are of substantially the same shape" refers not only to the case where they are of exactly the same shape, but also to the case where they are of slightly different shapes due to variation in manufacture.

In a plan view, as in FIG. 7A, the upper wiring traces 6 occupy substantially the entire region between an outer circle formed by arrangement of the outer metal pins 5*b* and an inner circle formed by arrangement of the inner metal pins 5*a*, except predetermined gaps between adjacent upper wiring traces 6. The width of the upper wiring traces 6 in the circumferential direction is thus increased. The same applies to the lower wiring traces 7 (see FIG. 7B).

As illustrated in FIG. 6, the upper wiring traces 6 are arranged to be displaced in the counterclockwise direction in a plan view from the respective lower wiring traces 7 forming pairs therewith, such that in a plan view the upper wiring traces 6 each have an overlap with the lower wiring trace 7 forming a pair therewith and also have an overlap with the lower wiring trace 7 adjacent in the counterclockwise direction to the lower wiring trace 7 forming the pair with the upper wiring trace 6. In the present embodiment, the upper wiring traces 6 are displaced from the respective lower wiring traces 7 forming pairs therewith in the circumferential direction (winding axis direction).

The inner metal pins 5*a* are each positioned in the overlap between one upper wiring trace 6 to which the inner metal pin 5*a* is connected and the lower wiring trace 7 forming a pair with the one upper wiring trace 6, whereas the outer metal pins 5*b* are each positioned in the overlap between one upper wiring trace 6 to which the outer metal pin 5*b* is connected and the lower wiring trace 7 adjacent in the counterclockwise direction to the lower wiring trace 7 forming a pair with the one upper wiring trace 6.

The present embodiment can achieve the following advantageous effects as well as those achieved by the coil component 1*a* of the first embodiment. That is, since the upper and lower wiring traces 6 and 7 are of the same shape, the wiring traces 6 and 7 have the same wiring resistance. This makes it possible to suppress the local heat generation caused by varying wiring resistance in the coil electrode 4. It is also possible to reduce an impedance mismatch between the upper wiring traces 6 and the lower wiring traces 7 to which the metal pins 5*a* and 5*b* are connected.

Since the wiring traces 6 and 7 are of substantially the same shape and are arranged at substantially regular intervals, it is possible to reduce a difference in heat generation caused by a density difference between the wiring traces 6 and 7.

As described above, on each of the upper and lower surfaces of the insulating layer 2, the wiring traces 6 or 7 occupy substantially the entire region between the outer circle formed by arrangement of the outer metal pins 5*b* and the inner circle formed by arrangement of the inner metal pins 5*a*. Expanding the region where the wiring traces 6 and 7 are formed, as described above, can improve the capability of dissipating heat which is generated, for example, when the coil electrode 4 is energized.

Third Embodiment

Figure 8:
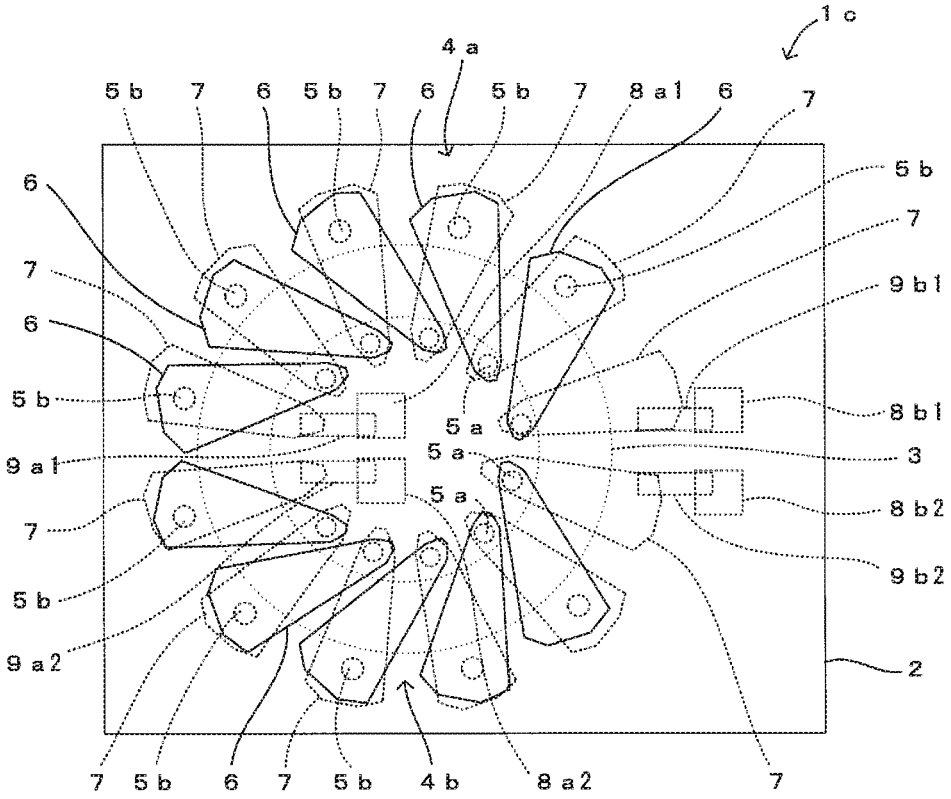
FIG. 8 is a plan view of a coil component according to a third embodiment of the present disclosure.
Figure 9A:
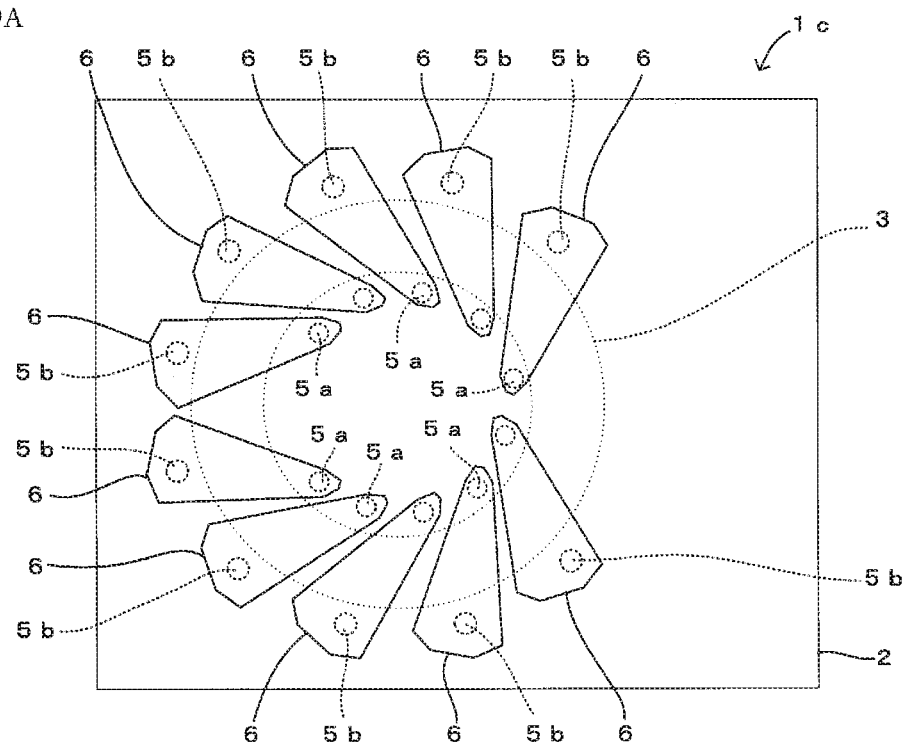
FIGS. 9A and 9B illustrate wiring traces illustrated in FIG. 8.
Figure 9B:
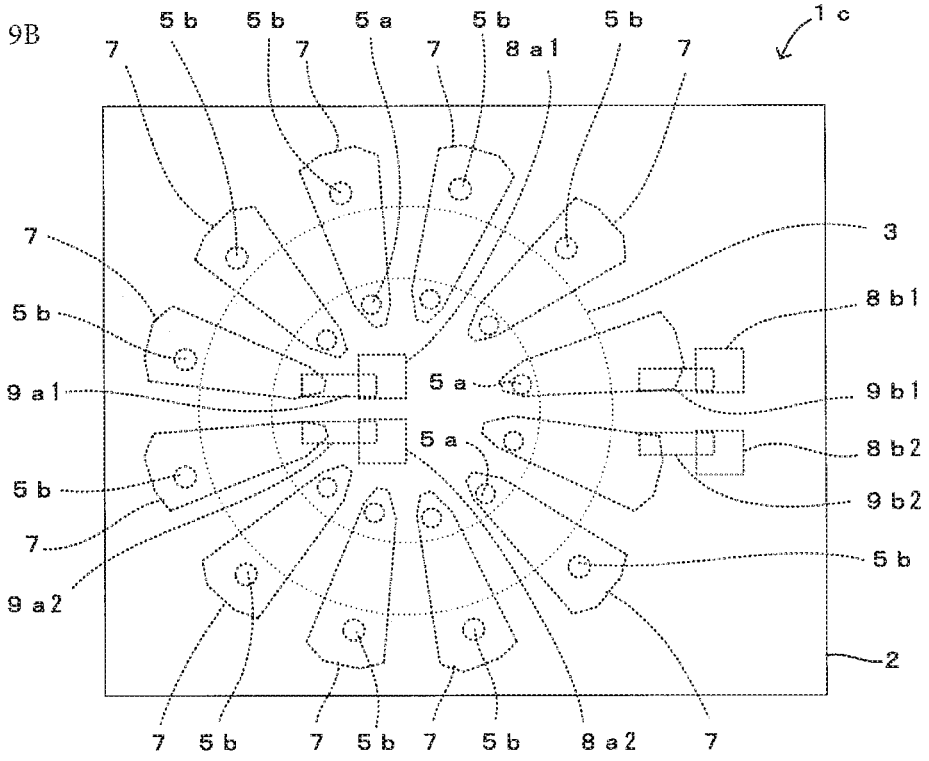

A coil component 1*c* according to a third embodiment of the present disclosure will be described with reference to FIGS. 8, 9A and 9B. FIG. 8 is a plan view of the coil component 1*c*, and FIGS. 9A and 9B illustrate the wiring traces 6 and 7. FIG. 9A is a plan view of the coil component 1*c* without the lower wiring traces 7, extended wires 9*a*1, 9*a*2, 9*b*1, and 9*b*2, input electrodes 8*a*1 and 8*a*2, and output electrodes 8*b*1 and 8*b*2. FIG. 9B is a plan view of the coil component 1*c* without the upper wiring traces 6.

The coil component 1*c* according to the present embodiment differs from the coil component 1*a* of the first embodiment described with reference to FIGS. 1 to 3A and 3B in that two coil electrodes 4*a* and 4*b* are wound around the coil core 3 as illustrated in FIG. 8. The other elements are the same as those of the coil component 1*a* of the first embodiment, and their description will be omitted by giving them the same reference numerals as those in the first embodiment.

Specifically, the coil electrode 4 of the first embodiment is divided into two parts to form the two coil electrodes 4*a* and 4*b*. One of the coil electrodes 4*a* and 4*b* is wound around half of the coil core 3 in the circumferential direction, and the other is wound around the remaining half of the coil core 3 in the circumferential direction. Note that the coil component 1*c* is used, for example, as a pulse transformer coil.

Like the coil electrode 4 of the first embodiment, the first and second ends of each of the coil electrodes 4*a* and 4*b* are each formed by one lower wiring trace 7 (see FIG. 9B). The lower wiring trace 7 forming the first end of the coil electrode 4*a* is connected to the input electrode 8*a*1, with the extended wire 9*a*1 on the inner periphery side of the coil core 3 interposed therebetween, whereas the lower wiring trace 7 forming the second end of the coil electrode is connected to the output electrode 8*b*1, with the extended wire 9*b*1 on the outer periphery side of the coil core 3 interposed therebetween.

The other coil electrode 4*b* is connected to the input electrode 8*a*2, with the extended wire 9*a*2 on the inner periphery side of the coil core 3 interposed therebetween, whereas the lower wiring trace 7 forming the second end of the coil electrode is connected to the output electrode 8*b*2, with the extended wire 9*b*2 on the outer periphery side of the coil core 3 interposed therebetween. That is, in the present embodiment, the input electrodes 8*a*1 and 8*a*2 corresponding to the coil electrodes 4*a* and 4*b*, respectively, are both disposed on the inner periphery side of the coil core 3, whereas the output electrodes 8*b*1 and 8*b*2 corresponding to the coil electrodes 4*a* and 4*b*, respectively, are both disposed on the outer periphery side of the coil core 3.

The arrangement of the input electrodes 8*a*1 and 8*a*2 and the output electrodes 8*b*1 and 8*b*2 may be appropriately changed in accordance with the size of the region surrounded by the coil core 3 (i.e., the region on the inner periphery side of the coil core 3). For example, only the input electrode 8*a*1 corresponding to the coil electrode 4*a* may be disposed on the inner periphery side of the coil core 3, or the input electrodes 8*a*1 and 8*a*2 and output electrodes 8*b*1 and 8*b*2, each corresponding to one of the coil electrodes 4*a* and 4*b*, may all be disposed on the inner periphery side of the coil core 3.

With this configuration, the coil component 1*c* formed by winding the plurality of coil electrodes 4*a* and 4*b* around the coil core 3 having a ring shape can achieve advantageous effects similar to those achieved by the coil component 1*a* of the first embodiment.

(Modification of Coil Core)

Figure 10:
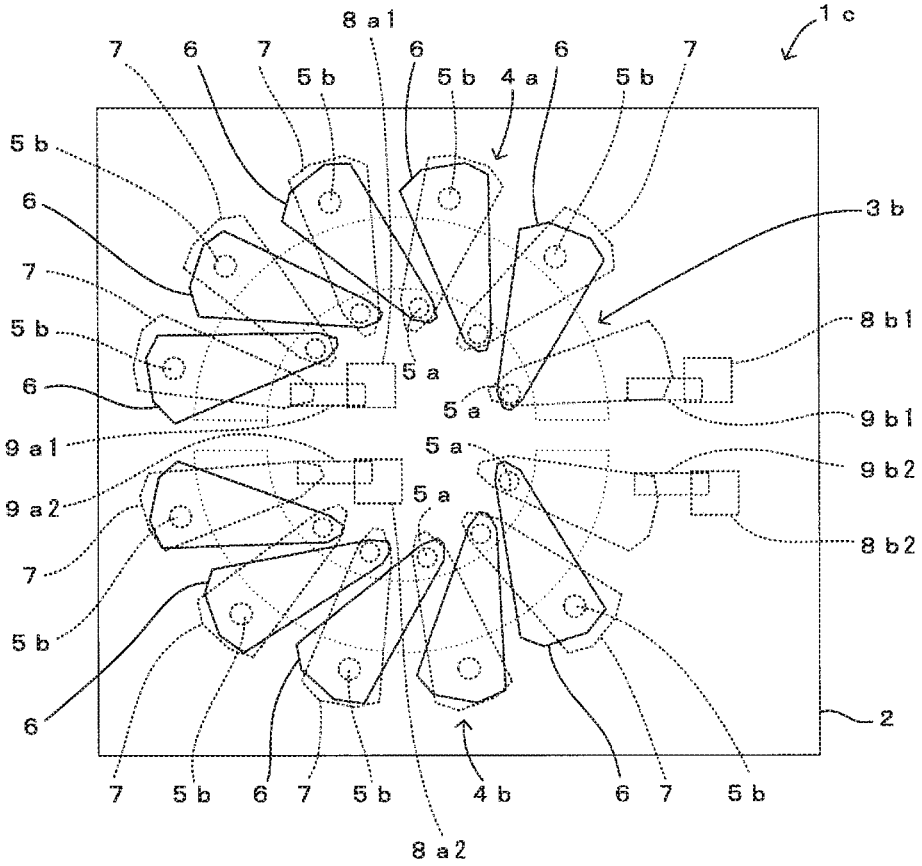
FIG. 10 illustrates a modification of the coil core illustrated in FIG. 8.

A modification of the coil core 3 of the present embodiment will now be described with reference to FIG. 10. FIG. 10 is a plan view of the coil component 1*c* and illustrates a modification of the coil core 3.

A coil core 3*b* according to the present modification is formed into a shape obtained by evenly dividing an annular ring-shaped coil core into two parts by two gaps. One of the two parts of the coil core 3*b* is used as a coil core for the coil electrode 4*a*, and the other is used as a coil core for the coil electrode 4*b*. With this configuration, it is still possible to reduce the size and improve the heat dissipation characteristics of the coil component 1*c*.

Fourth Embodiment

Figure 11:
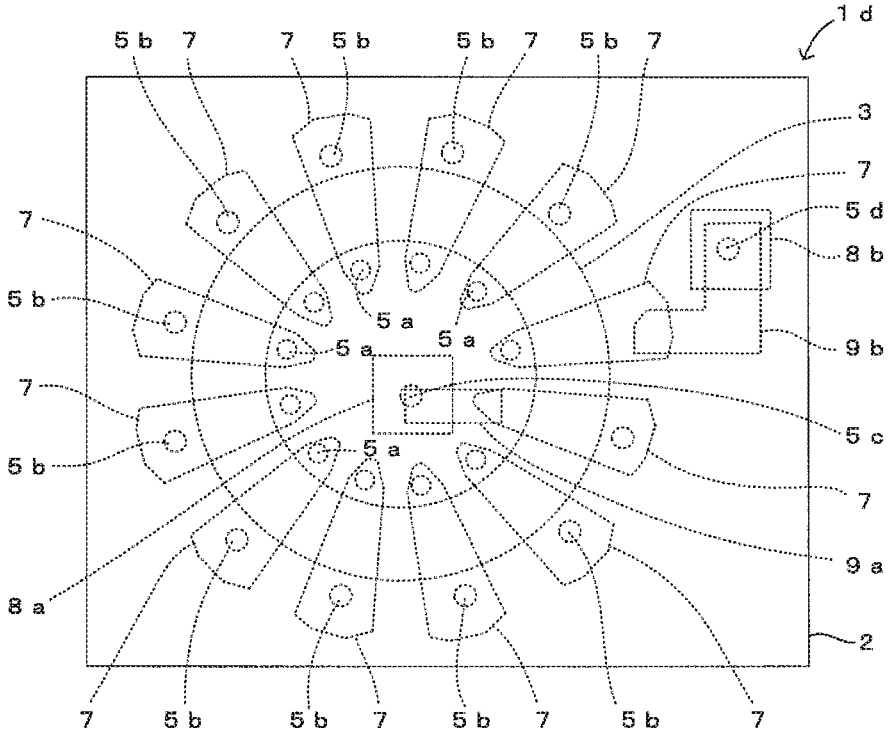
FIG. 11 is a plan view of a coil component according to a fourth embodiment of the present disclosure.

A coil component 1*d* according to a fourth embodiment of the present disclosure will be described with reference to FIG. 11. FIG. 11 is a plan view of the coil component 1*d* without the upper wiring traces 6.

The coil component 1*d* according to the present embodiment differs from the coil component 1*a* of the first embodiment described with reference to FIGS. 1 to 3A and 3B in that, as illustrated in FIG. 11, the input electrode 8*a* and the output electrode 8*b* are connected to dummy metal pins 5*c* and 5*d* (corresponding to "dummy conductor" of the present disclosure), respectively, designed for heat dissipation and disposed internally in the insulating layer 2. The other elements are the same as those of the coil component 1*a* of the first embodiment, and their description will be omitted by giving them the same reference numerals as those in the first embodiment.

The dummy metal pins 5*c* and 5*d* are of the same material and diameter as the inner and outer metal pins 5*a* and 5*b*, and are configured to stand upright in the thickness direction of the insulating layer 2 in the same manner as the inner and outer metal pins 5*a* and 5*b*. The dummy metal pins 5*c* and 5*d* are exposed, at the lower ends thereof, on the lower surface of the insulating layer 2 and connected to the input and output electrodes 8*a* and 8*b*, respectively. The dummy metal pins 5*c* and 5*d* do not form part of the coil electrode 4, and are used as conductors for heat dissipation.

Only one of the input and output electrodes 8*a* and 8*b* may be connected to a dummy metal pin. The dummy metal pins 5*c* and 5*d* may be replaced by columnar conductors, such as via conductors.

With this configuration, where the dummy metal pins 5*c* and 5*d* having a thermal conductivity higher than the insulating layer 2 are disposed on the input and output electrodes 8*a* and 8*b*, the heat dissipation characteristics of the coil component 1*d* can be further improved.

(Modification of Coil Component)

Figure 12:
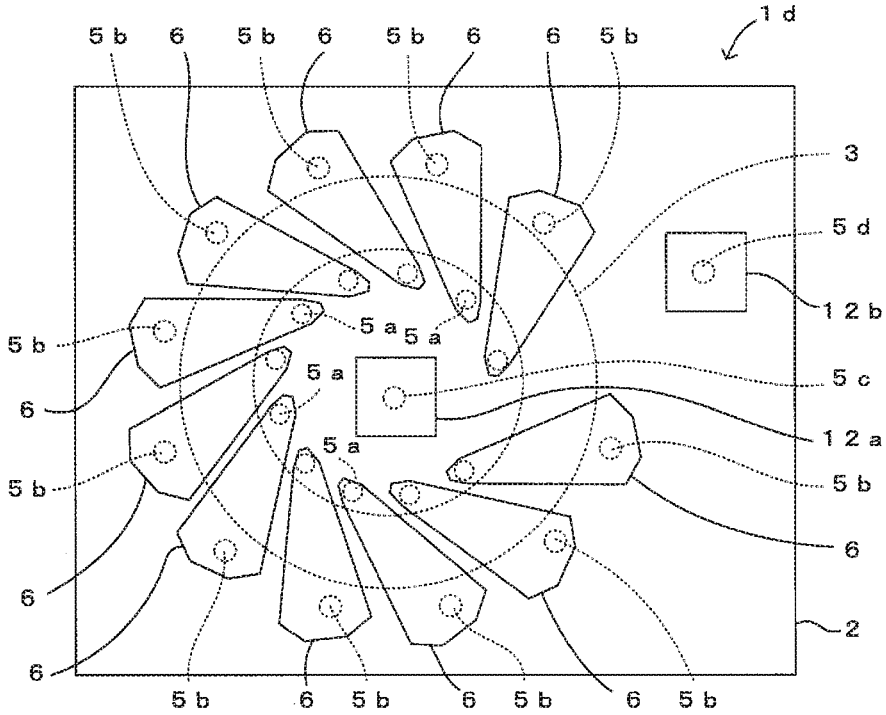
FIG. 12 illustrates a modification of the coil component illustrated in FIG. 11.

A modification of the coil component 1*d* will now be described with reference to FIG. 12. FIG. 12 is a plan view of the coil component 1*d* according to the present modification, without the lower wiring traces 7, the extended wires 9*a* and 9*b*, and the input and output electrodes 8*a* and 8*b*.

In this case, the dummy metal pins 5*c* and 5*d* are disposed with the upper ends thereof exposed from the upper surface of the insulating layer 2, and dummy electrodes 12*a* and 12*b* designed for heat dissipation and connected to the upper ends of the dummy metal pins 5*c* and 5*d* are formed on the upper surface of the insulating layer 2.

With this configuration, which includes the dummy electrodes 12*a* and 12*b*, the heat dissipation characteristics of the coil component 1*d* can be further improved. The dummy electrodes 12*a* and 12*b* may also be used as input and output electrodes for external connection.

Fifth Embodiment

Figure 13:
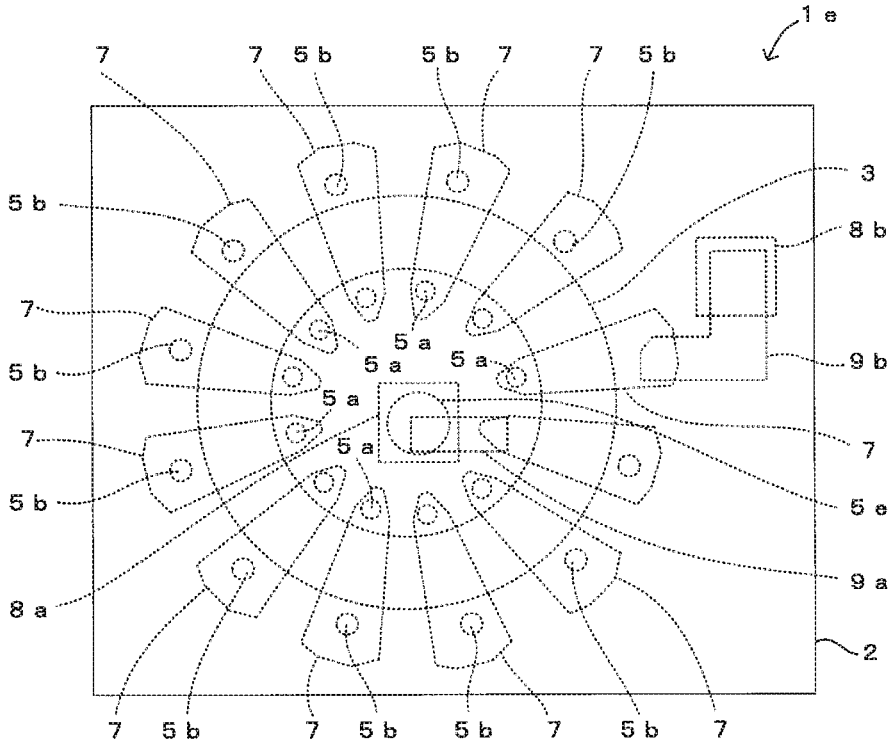
FIG. 13 is a plan view of a coil component according to a fifth embodiment of the present disclosure.
Figure 14:
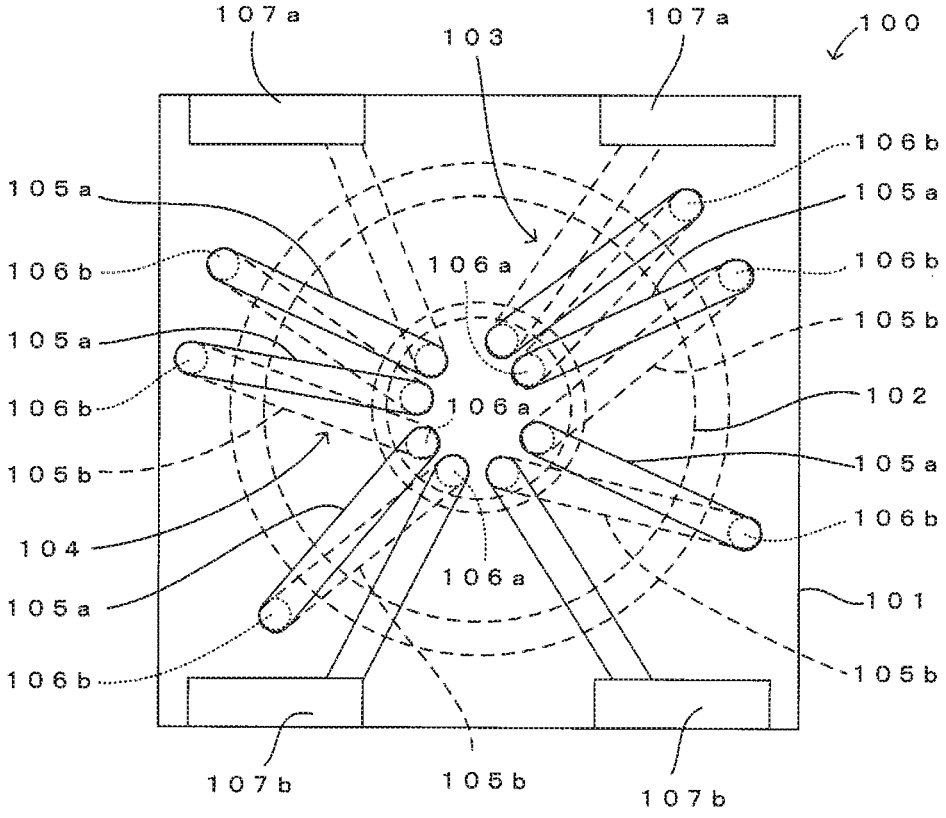
FIG. 14 is a plan view of a conventional coil component.

A coil component 1*e* according to a fifth embodiment of the present disclosure will be described with reference to FIG. 13. FIG. 13 is a plan view of the coil component 1*e* without the upper wiring traces 6. FIG. 13 corresponds to FIG. 11.

The coil component 1*e* according to the present embodiment differs from the coil component 1*d* of the fourth embodiment described with reference to FIG. 11 in that, as illustrated in FIG. 13, a dummy metal pin 5*e* is provided only for the input electrode 8*a* disposed on the inner periphery side of the coil core 3, and the dummy metal pin 5*e* is larger in diameter than both the inner and outer metal pins 5*a* and 5*b*. The other elements are the same as those of the coil component 1*d* of the fourth embodiment, and their description will be omitted by giving them the same reference numerals as those in the fourth embodiment.

On the inner periphery side of the coil core 3, the density of conductors, such as the inner metal pins 5*a*, forming the coil electrode 4 is high. As a result, resistance heat generated when the coil electrode 4 is energized may accumulate on the inner periphery side of the coil core 3. With the dummy metal pin 5*e* on only the inner periphery side of the coil core 3, efficient heat dissipation can be achieved. Small-diameter metal pins are used as the inner and outer metal pins 5*a* and 5*b* to increase the number of turns of the coil electrode 4, whereas a large-diameter metal pin is used as the dummy metal pin 5*e*, so that the heat dissipation characteristics of the coil component 1*e* can be improved.

In the present embodiment, as in the case of the modification of the coil component 1*d* according to the fourth embodiment described with reference to FIG. 12, the upper end of the dummy metal pin 5*e* may be exposed from the upper surface of the insulating layer 2, and a dummy electrode designed for heat dissipation and connected to the upper face of the dummy metal pin 5*e* may be formed on the upper surface of the insulating layer 2. A dummy metal pin similar to the dummy metal pin 5*e* may also be provided for the output electrode 8*b*.

The present disclosure is not limited to the embodiments described above, and various changes other than those described above can be made thereto within the scope of the present disclosure. For example, the insulating layer 2 may be made of a ceramic material.

Different elements according to different ones of the above-described embodiments may be combined.

In the embodiments described above, the input electrode 8*a* may be disposed outside the coil core 3 and the output electrode 8*b* may be disposed inside the coil core 3.

In the embodiments described above, as in the modified arrangement of the input and output electrodes 8*a* and 8*b* of the first embodiment, both the input electrode 8*a* and the output electrode 8*b* may be disposed on the inner periphery side of the coil core 3 (i.e., within the predetermined region) in a plan view.

The present disclosure is widely applicable to various types of coil components that include an insulating layer having a coil core embedded therein and a coil electrode wound around the coil core.

1*a* to 1*e*: coil component
2: insulating layer
3, 3*a*, 3*b*: coil core
4, 4*a*, 4*b*: coil electrode
5*a*: inner metal pin (inner conductor)
5*b*: outer metal pin (outer conductor)
5*c*, 5*d*, 5*e*: dummy metal pin (dummy conductor)
6: upper wiring trace (first wiring trace)
7: lower wiring trace (second wiring trace)
8*a*: input electrode
8*b*: output electrode

The invention claimed is:

1. A coil component comprising:

an insulating layer;

a coil core embedded in the insulating layer so as to surround a predetermined region, wherein the coil core is in the shape of an annular ring having a gap therein;

a coil electrode wound around the coil core;

an input electrode designed for external connection, disposed on one of a first principal surface and a second principal surface of the insulating layer, and connected to a first end of the coil electrode via a first extended wire; and an output electrode designed for external connection, disposed on one of the first principal surface and the second principal surface of the insulating layer, and connected to a second end of the coil electrode via a second extended wire, wherein the input electrode is larger than the first end of the coil electrode and the output electrode is larger than the second end of the coil electrode, and both the input electrode and the output electrode are disposed inside the coil core without overlapping each other in a plan view.

2. The coil component according to claim 1, wherein the other of the input electrode and the output electrode is disposed outside the coil core in a plan view; and both the input electrode and the output electrode are disposed on one of the first principal surface and the second principal surface of the insulating layer.

3. The coil component according to claim 1, wherein at least one of the input electrode and the output electrode is connected to a dummy conductor for heat dissipation, the dummy conductor being disposed internally in the insulating layer.

4. The coil component according to claim 1, wherein the coil electrode includes a plurality of first wiring traces each having a first end disposed inside the coil core and a second end disposed outside the coil core, the plurality of first wiring traces being arranged on the first principal surface of the insulating layer in a winding axis direction of the coil electrode, a plurality of second wiring traces each having a first end disposed inside the coil core and a second end disposed outside the coil core, the plurality of second wiring traces being arranged on the second principal surface of the insulating layer in the winding axis direction of the coil electrode so as to form a plurality of pairs with the respective first wiring traces, a plurality of inner conductors disposed inside the coil core, the plurality of inner conductors each being configured to connect the first end of one of the first wiring traces to the first end of each of the second wiring traces forming a pair with the one of the first wiring traces, and a plurality of outer conductors disposed outside the coil core, the plurality of outer conductors each being configured to connect the second end of one of the first wiring traces to the second end of one of the second wiring traces adjacent to each of the second wiring traces forming a pair with the one of the first wiring traces; and each of the inner conductors and the outer conductors comprises a metal pin.

5. The coil component according to claim 3, wherein the coil electrode includes a plurality of first wiring traces each having a first end disposed inside the coil core and a second end disposed outside the coil core, the plurality of first wiring traces being arranged on the first principal surface of the insulating layer in a winding axis direction of the coil electrode, a plurality of second wiring traces each having a first end disposed inside the coil core and a second end disposed outside the coil core, the plurality of second wiring traces being arranged on the second principal surface of the insulating layer in the winding axis direction of the coil electrode so as to form a plurality of pairs with the respective first wiring traces, a plurality of inner conductors disposed inside the coil core, the plurality of inner conductors each being configured to connect the first end of one of the first wiring traces to the first end of each of the second wiring traces forming a pair with the one of the first wiring traces, and a plurality of outer conductors disposed outside the coil core, the plurality of outer conductors each being configured to connect the second end of one of the first wiring traces to the second end of one of the second wiring traces adjacent to each of the second wiring traces forming a pair with the one of the first wiring traces;

each of the dummy conductor, the inner conductors, and the outer conductors comprises a metal pin; and the dummy conductor is larger in diameter than the inner conductors and the outer conductors.

6. The coil component according to claim 2, wherein at least one of the input electrode and the output electrode is connected to a dummy conductor for heat dissipation, the dummy conductor being disposed internally in the insulating layer.

7. The coil component according to claim 1, wherein at least one of the input electrode and the output electrode is connected to a dummy conductor for heat dissipation, the dummy conductor being disposed internally in the insulating layer.

8. The coil component according to claim 2, wherein the coil electrode includes a plurality of first wiring traces each having a first end disposed inside the coil core and a second end disposed outside the coil core, the plurality of first wiring traces being arranged on the first principal surface of the insulating layer in a winding axis direction of the coil electrode, a plurality of second wiring traces each having a first end disposed inside the coil core and a second end disposed outside the coil core, the plurality of second wiring traces being arranged on the second principal surface of the insulating layer in the winding axis direction of the coil electrode so as to form a plurality of pairs with the respective first wiring traces, a plurality of inner conductors disposed inside the coil core, the plurality of inner conductors each being configured to connect the first end of one of the first wiring traces to the first end of each of the second wiring traces forming a pair with the one of the first wiring traces, and a plurality of outer conductors disposed outside the coil core, the plurality of outer conductors each being configured to connect the second end of one of the first wiring traces to the second end of one of the second wiring traces adjacent to each of the second wiring traces forming a pair with the one of the first wiring traces; and each of the inner conductors and the outer conductors comprises a metal pin.

9. The coil component according to claim 1, wherein the coil electrode includes a plurality of first wiring traces each having a first end disposed inside the coil core and a second end disposed outside the coil core, the plurality of first wiring traces being arranged on the first principal surface of the insulating layer in a winding axis direction of the coil electrode, a plurality of second wiring traces each having a first end disposed inside the coil core and a second end disposed outside the coil core, the plurality of second wiring traces being arranged on the second principal surface of the insulating layer in the winding axis direction of the coil electrode so as to form a plurality of pairs with the respective first wiring traces, a plurality of inner conductors disposed inside the coil core, the plurality of inner conductors each being configured to connect the first end of one of the first wiring traces to the first end of each of the second wiring traces forming a pair with the one of the first wiring traces, and a plurality of outer conductors disposed outside the coil core, the plurality of outer conductors each being configured to connect the second end of one of the first wiring traces to the second end of one of the second wiring traces adjacent to each of the second wiring traces forming a pair with the one of the first wiring traces; and each of the inner conductors and the outer conductors comprises a metal pin.

10. The coil component according to claim 3, wherein the coil electrode includes a plurality of first wiring traces each having a first end disposed inside the coil core and a second end disposed outside the coil core, the plurality of first wiring traces being arranged on the first principal surface of the insulating layer in a winding axis direction of the coil electrode, a plurality of second wiring traces each having a first end disposed inside the coil core and a second end disposed outside the coil core, the plurality of second wiring traces being arranged on the second principal surface of the insulating layer in the winding axis direction of the coil electrode so as to form a plurality of pairs with the respective first wiring traces, a plurality of inner conductors disposed inside the coil core, the plurality of inner conductors each being configured to connect the first end of one of the first wiring traces to the first end of each of the second wiring traces forming a pair with the one of the first wiring traces, and a plurality of outer conductors disposed outside the coil core, the plurality of outer conductors each being configured to connect the second end of one of the first wiring traces to the second end of one of the second wiring traces adjacent to each of the second wiring traces forming a pair with the one of the first wiring traces; and each of the inner conductors and the outer conductors comprises a metal pin.

11. The coil component according to claim 1, wherein the first end of the coil electrode is disposed at a first side of the gap, and the second end of the coil electrode is disposed at a second side of the gap.

* * * * *